US009510701B1

(12) United States Patent
Larcher et al.

(10) Patent No.: US 9,510,701 B1
(45) Date of Patent: Dec. 6, 2016

(54) DRINKING CONTAINER WITH HANDLE ON CUP MAINTAINED BELOW OPENING IN LID

(71) Applicants: Carol Ann Larcher, Dyer, IN (US); Genoa Lynne Larcher, Dyer, IN (US)

(72) Inventors: Carol Ann Larcher, Dyer, IN (US); Genoa Lynne Larcher, Dyer, IN (US)

( * ) Notice: Subject to any disclaimer, the term of this patent is extended or adjusted under 35 U.S.C. 154(b) by 0 days.

(21) Appl. No.: 14/690,455

(22) Filed: Apr. 19, 2015

Related U.S. Application Data

(63) Continuation-in-part of application No. 14/326,444, filed on Jul. 8, 2014, now abandoned.

(60) Provisional application No. 61/845,343, filed on Jul. 11, 2013.

(51) Int. Cl.

| | |
|---|---|
| ***A47G 19/22*** | (2006.01) |
| ***B65D 25/28*** | (2006.01) |
| ***B65D 47/12*** | (2006.01) |
| ***B65D 55/16*** | (2006.01) |
| ***B65D 43/16*** | (2006.01) |

(52) U.S. Cl.

CPC ..... *A47G 19/2272* (2013.01); *B65D 25/2811* (2013.01); *B65D 43/16* (2013.01); *B65D 47/122* (2013.01); *B65D 55/16* (2013.01); *B65D 2543/00592* (2013.01)

(58) Field of Classification Search

CPC ..... A47G 19/2266; A47G 19/2272; A47G 19/2205; A61J 19/00; A61J 19/0623; B65D 55/16

USPC ..... 220/710.5, 713, 717, 375, 755, 756, 220/767; 215/11.6, 389, 396, 11.1; 222/465.1

See application file for complete search history.

(56) References Cited

U.S. PATENT DOCUMENTS

| | | | | |
|---|---|---|---|---|
| 4,898,297 | A | 2/1990 | Wheeler | |
| 5,361,934 | A * | 11/1994 | Spence, Jr. | A47G 19/2266 215/388 |
| 5,549,216 | A * | 8/1996 | Scholl | B44D 3/12 220/695 |
| 5,558,240 | A | 9/1996 | Karp | |
| 5,570,797 | A | 11/1996 | Yeh | |
| 5,586,682 | A | 12/1996 | Yeh | |
| 5,816,631 | A | 10/1998 | Kochan | |
| 6,076,699 | A | 6/2000 | Seager et al. | |
| 6,276,560 | B1 * | 8/2001 | Belcastro | A47G 19/2266 220/709 |
| 6,302,286 | B1 * | 10/2001 | Witherspoon | A61J 11/008 215/11.1 |
| 6,793,075 | B1 | 9/2004 | Jeter | |
| 7,207,538 | B2 * | 4/2007 | Kent-Fawkes | B65D 23/106 215/395 |
| D559,624 | S | 1/2008 | Carreno | |
| D559,662 | S | 1/2008 | Carreno | |

(Continued)

OTHER PUBLICATIONS

US 7,184,784, 03/2007, Connors, Jr., (withdrawn).

*Primary Examiner* — Steven A. Reynolds

(74) *Attorney, Agent, or Firm* — Carol Larcher; Larcher & Chao Law Group

(57) ABSTRACT

A drinking container (1) including a cup (2) and a lid (3), wherein the lid (3) includes an opening (4) and the cup (2) includes only one handle (5), wherein, when the lid (3) is fully engaged with the cup (2), the opening (4) in the lid (3) can only be maintained on the same side of the cup as the handle (5), above and aligned with the handle (5); and a method of making the drinking container (1).

17 Claims, 7 Drawing Sheets

(56) References Cited

U.S. PATENT DOCUMENTS

| | | | | |
|---|---|---|---|---|
| D579,721 | S | 11/2008 | Qian | |
| D579,722 | S | 11/2008 | Sakulsacha | |
| 7,673,766 | B1 | 3/2010 | Yalon | |
| D632,133 | S | 2/2011 | Giraud | |
| 8,118,182 | B1 | 2/2012 | Licari | |
| 8,256,642 | B2 | 9/2012 | McNamara | |
| 8,286,826 | B2 | 10/2012 | Connors, Jr. | |
| 8,418,877 | B2 | 4/2013 | Phillips | |
| 2006/0006184 | A1 | 1/2006 | Bohman | |
| 2008/0006643 | A1* | 1/2008 | Ma | A47J 41/0061 220/592.16 |
| 2008/0257845 | A1 | 10/2008 | Rossi | |
| 2009/0223969 | A1* | 9/2009 | Bouie | B65D 1/265 220/375 |
| 2014/0199678 | A1* | 7/2014 | Tunis | F41H 5/08 434/408 |

* cited by examiner

DRINKING CONTAINER WITH HANDLE ON CUP MAINTAINED BELOW OPENING IN LID

CROSS REFERENCE TO RELATED APPLICATIONS

This application is a continuation-in-part of co-pending U.S. patent application Ser. No. 14/326,444, which was filed Jul. 8, 2014, with a claim of priority to U.S. provisional patent application No. 61/845,343, which was filed Jul. 11, 2013. Both prior applications are hereby incorporated by reference in their entireties.

TECHNICAL FIELD

This disclosure relates to a drinking container, in particular a spill-resistant drinking container commonly known as a "sippy cup".

BACKGROUND

Children's drinking cups are frequently provided with removable lids to help prevent spills. A typical lid has a drinking spout, which is adjacent to the edge of the lid and extends from the upper surface of the lid. A child places the drinking spout in his/her mouth to sip from the cup; hence the name "sippy cup". Typically, the lid snaps or screws on the cup, and the drinking spout has a slot or one or more holes through which a liquid in the cup flows when the cup is inverted. Some sippy cups are equipped with a valve, which only allows liquid to flow through the drinking spout when a child applies suction to the drinking spout. Sippy cups typically come with two handles, one on each side of the cup with the drinking spout positioned midway between the two handles, or no handles. Some sippy cups without handles have a region of smaller diameter or other ergonomic feature for gripping. Sippy cups with two handles are typically recommended for younger children, such as children under 12 months of age, whereas sippy cups without handles are typically recommended for older children, such as children over 12 months of age.

U.S. Pat. No. 6,793,075 discloses a drinking cup having a spill-proof lid and a container. In one embodiment, the lid screws onto the container by means of a threaded engagement. In another embodiment, the lid is friction-fit onto the container. While the friction-fit engagement is described as advantageous over the threaded engagement because the drinking orifice may be rotated and positioned anywhere with respect to the handle for ease of drinking, no positions of the drinking orifice relative to the handle are described, let alone positions of the drinking orifice relative to the handle for ease of drinking U.S. Pat. No. 7,185,784 discloses a sippy cup with a snap-on lid. The snap-on lid has a drinking spout with multiple open holes reportedly sized to resist leakage in the absence of suction and a valve. See, also, U.S. Pat. No. 8,286,826.

U.S. Pat. No. 8,118,182 also discloses a sippy cup with a snap-on lid. The combination of an annular ring and an annular groove reportedly seal the container from leakage. Squeeze tabs on the snap-on lid reportedly aid removal of the lid. The sippy cup is described as having an ergonomic shape.

U.S. Pat. No. 8,256,642 discloses a sippy cup that includes a valve insert. The valve insert has a sheath and a stabilizing core, which is more rigid than the sheath. The valve insert reportedly prevents leakage of liquid from the container when no suction is applied to the drinking spout.

U.S. Pat. No. 8,418,877 discloses a sippy cup with an internal partition. The internal partition is angled toward the mouth of the sippy cup to decrease the amount of tilt required to dispense the entirety of the liquid from the sippy cup.

U.S. Pat. App. Pub. No. 2006/0006184 discloses a sippy cup with a hinged lid. The hinge is adjacent to the drinking spout.

U.S. Pat. App. Pub. No. 2008/0257845 discloses a baby bottle container. The container includes a cap and a bottle. The bottle has a weighted end piece, which includes a smooth, curved hemispherical surface and biases the bottle body to an upright position.

U.S. Pat. App. Pub. No. 2009/0223969 discloses a combination of a cup and a lid assembly. The lid assembly includes a band secured on the top of the cup, a lid secured on the band, and a tether having a first end and a second end, wherein the first end is connected to the band, and the second end is connected to the lid.

Various designs for sippy cups are disclosed in U.S. Pat. No. D559,622, D559,624, D579,721, D579,722, and D632133. The designs of U.S. Pat. Nos. D559,622 and D632,133 do not include a handle, whereas the design of U.S. Pat. No. D559,624 includes two, open handles, one on each side of the cup with the drinking spout disposed between the two open handles, the open ends of which face downward. The designs of U.S. Pat. No. D579,721 and D579,722 include two, open handles, one on each side of the cup with the drinking spout disposed between the two open handles, the open ends of which face upward. Yet another design is disclosed in GR3031664; that design includes a central opening in a cylindrical cup resulting in tubular sections, one on each side of a drinking spout in the lid, which can be grasped as handles.

The website "oneinhundred.com" offers a silver-plated sippy cup that includes a single handle. The plastic lid includes a drinking spout that is positioned at a 90° angle from the handle. See, also, similar silver-plated sippy cups offered by the websites "cornerstorkbabygifts.com" and "engravingshop.com."

U.S. Pat. No. 7,207,538 discloses a plastic beverage bottle holder. The bottle holder is described as specifically designed for use in combination with plastic beverage bottles by persons with reduced hand strength and motor skills due to age, infirmities, and disease.

In view of the above, there remains a need for a drinking container with a handle on a cup maintained below an opening in a lid. It is an object of the present disclosure to provide such a drinking container. This and other objects and advantages, as well as inventive features, will become apparent from the detailed description provided herein.

SUMMARY

A drinking container (1) comprising a cup (2) and a lid (3) is provided. The lid (3) comprises an opening (4) for egress of a liquid placed inside the cup (2). The cup (2) comprises only one handle (5). When the lid (3) is fully engaged with the cup (2), the opening (4) in the lid (3) can only be maintained on the same side of the cup as the handle (5), wherein the opening (4) is above and aligned with the handle (5).

In an embodiment, the lid (3) screws on the cup (2). In this embodiment, the drinking container can further comprise a tether (15), which keeps the lid (3) attached to the cup (2) when the lid is not screwed on the cup (2).

In another embodiment, the drinking container further comprises a hinge (14), which attaches the lid (3) to the cup (2). In this embodiment, the lid (3) snaps on the cup (2).

In yet another embodiment, the lid (3) of the drinking container further comprises at least two slots (17) and the cup further comprises at least two tabs (16). In this embodiment, the lid (3) twists on the cup (2). In this embodiment, the drinking container can further comprise a tether (15), which keeps the lid (3) attached to the cup (2) when the lid is not twisted on the cup (2).

The lid (3) of the drinking containers can further comprise a drinking spout (6) and the opening (4) is in the drinking spout (6). Alternatively, the lid (3) of the drinking containers can comprise a ridge (7), which has an inner side (8) and an outer side (9), and the opening (4) is adjacent to the inner side (8) of the ridge.

The handle (5) of the drinking containers can have a thumb rest (10) on the upper surface of the top of the handle (5). The thumb rest (10) can be bifurcated, having a left thumb rest and a right thumb rest. The handle (5) can have a pointer finger (11) rest on the lower surface of the top of the handle (5). The bottom of the handle (5) can be flared. The handle (5) can have a little finger rest (12) on the upper surface of the bottom of the handle (5). The little finger rest (12) can be bifurcated, having a left little finger rest and a right little finger rest.

The drinking containers can further comprise a chin rest (13). The chin rest (13) can be on the lid.

The drinking containers can further comprise padding (18) on the side of the cup (2) facing the inside of the handle (5).

In view of the above, also provided is a method of making the drinking container. The drinking container can be made using materials and methods known in the art.

BRIEF DESCRIPTION OF THE FIGURES

FIG. 6(*b*) is a bottom view of a lid (3). Shown are two slots (17), an opening (4), an example of a drinking spout (6), and a tether (15), which keeps the lid attached to the cup when the lid is untwisted from the cup.

FIG. 7(*b*) is a side view of a drinking container (1) showing a handle (5) substantially below and aligned with an opening (4) in a drinking spout (6) but offset to the left.

FIG. 7(*c*) is a side view of a drinking container (1) showing a handle (5) substantially below and aligned with an opening (4) in a drinking spout (6) but offset to the right.

FIG. 8(*b*) is a side view of a drinking container (1) showing a cup (2), a lid (3), an example of a drinking spout (6) with an opening (4), a handle (5), and padding (18), which can help to increase the area of contact between the side of the cup and the dorsal surfaces of the proximal phalanxes.

DETAILED DESCRIPTION

Figure 7A:
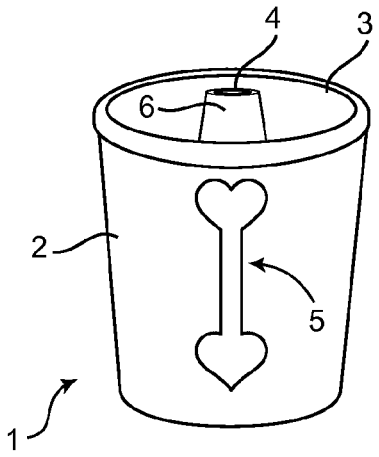
FIG. 7(*a*) is a side view of a drinking container (1) showing a handle (5) directly below and aligned with an opening (4) in a drinking spout (6).
Figure 7B:
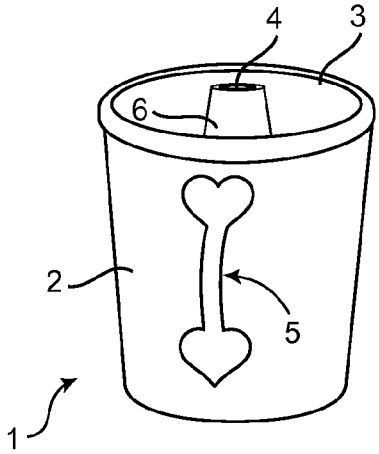
Figure 7C:
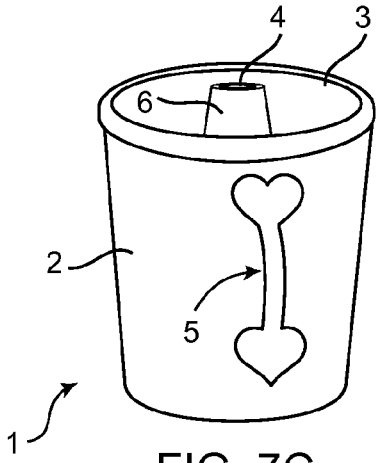

A drinking container (1) is provided. The drinking container (1) comprises a cup (2) and a lid (3). The lid (3) comprises an opening (4) for egress of a liquid placed inside the cup (2). The cup (2) comprises only one handle (5). When the lid (3) is fully engaged with (such as, for example, fully screwed on, fully snapped on, or fully twisted on) the cup (2), the opening (4) in the lid (3) can only be maintained on the same side of the cup as the handle (5), wherein the opening (4) is above and aligned with the handle (5). Thus, while the opening (4) is in the lid (3) and the handle (5) is on the cup (2), the handle (5) is generally in line with, such as in line with, the opening (4) in the lid (3) as shown, for example, in FIGS. 1, 2, 3, 7 and 8. The alignment of the opening (4) in the lid (3) and the handle (5) on the cup (2) need not be exact. Some degree of offset of the opening (4) to either side of the handle (5) is acceptable (see, e.g., FIGS. 7(*a*)-7(*c*)); however, when viewed from the side, as viewing the drinking container (1) shown in FIGS. 3 and 7, there should be sufficient overlap between the position of the opening (4) in the lid (3) and the position of the handle (5) on the cup (2) that the handle (5) on the cup (2) is considered substantially below (e.g., as in FIGS. 7(*b*) and 7(*c*)), or below (e.g., as in FIG. 7(*a*)), the opening (4) in the lid (3). In this position the length of the handle (5) is generally in line with, such as in line with, the opening (4) in the lid (3). Put another way, the top and the bottom of the handle (5) are both below and in line with the opening (4) in the lid (3) or substantially below and in line with the opening (4) in the lid (3). For ease of reference, the drinking container may be referred to herein as a "sippy cup"; such reference is not intended to be limiting as the drinking container can be a sports drink container, a travel drink container, and the like. A sippy cup with a single handle maintained directly below the opening in the lid allows a child, such as a toddler, to raise the sippy cup to his mouth using an arm movement that approximates the arm movement that a child uses to suck his thumb. Such an arm movement can be more comfortable for the child and can cause less strain/stress on the hand, wrist, and arm than an arm movement required to raise a sippy cup having two handles with the opening in the lid positioned between the two handles. In this regard, the movement can be considered ergonomic. Such an arm movement also is advantageous when the child is reclining, such as in a stroller, inasmuch as the child can rest his upper arm against his chest wall when sipping from the cup. Similar benefits can be realized by adults, such as adults with weakness in the wrist and/or hand (e.g., reduced grip strength), impaired motor control/function, reduced neck extension, and dysphagia, by keeping the drinking container in line with the axis of the hand, wrist and forearm when the drinking container is raised to drink.

In an embodiment, the lid (3) screws on the cup (2). In this embodiment, the drinking container can further comprise a tether (15), which keeps the lid (3) attached to the cup (2) when the lid is not screwed on the cup (2).

In another embodiment, the drinking container further comprises a hinge (14), which attaches the lid (3) to the cup (2). In this embodiment, the lid (3) snaps on the cup (2).

In yet another embodiment, the lid (3) of the drinking container further comprises at least two slots (17) and the cup further comprises at least two tabs (16). The reverse is also possible, i.e., the slots are on the cup and the tabs are on the lid. In this embodiment, the lid (3) twists on the cup (2). In this embodiment, the drinking container can further comprise a tether (15), which keeps the lid (3) attached to the cup (2) when the lid is not twisted on the cup (2).

Depending on the size of the drinking container, the handle (5) can be placed equidistant between the top and the bottom of the cup (2). Alternatively, the handle (5) can be placed closer to the top or closer to the bottom of the cup (2). There should be sufficient space between the handle (5) and the opening (4) in the lid (3), such as a drinking spout (6) so that the handle (5) does not interfere with sipping from the drinking container. The amount of space will depend on whether the drinking container is intended for use by a child or an adult.

Figure 4:
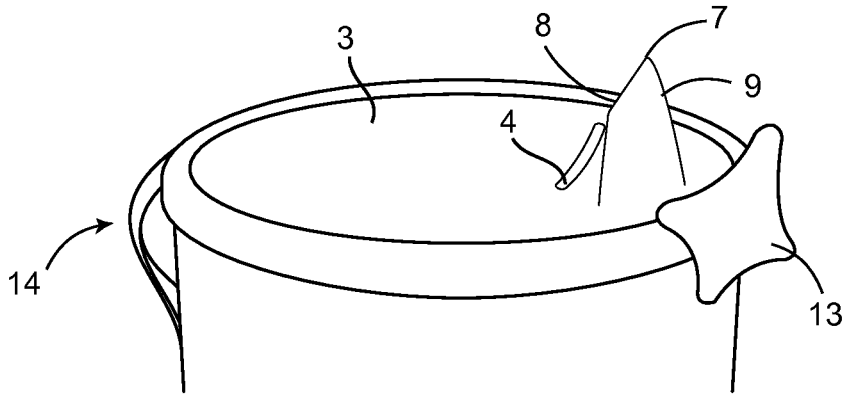
FIG. 4 is a side view of a lid (3). Shown are an opening (4), a ridge (7) having an inner side (8) and an outer side (9), and a chin rest (13). Also shown is a hinge (14) as an example of a means of attaching the lid to the cup and maintaining the opening (4) in the lid (3) above and aligned with the handle (5).
Figure 5:
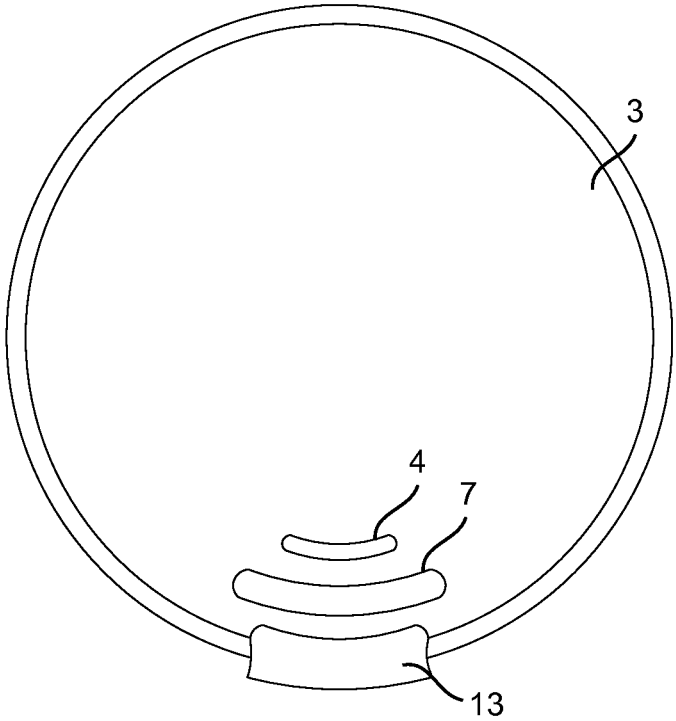
FIG. 5 is a top view of a lid (3). Shown are an opening (4), a ridge (7), and a chin rest (13).

The drinking container (1) can further comprise a chin rest (13). The chin rest can be part of, or added on to, the lid (3), such as the rim of the lid (3) adjacent to the opening (4), or part of, or added on to, the cup (2), such as the side wall of the cup just below the lid (3) and above the top of the handle (5), e.g., above the thumb rest (10) on the top of the handle (5). See, e.g., the example chin rest (13) shown in FIGS. 4 and 5.

The handle (5) can have any suitable conformation. The handle (5) can have two ends, i.e., a top end and a bottom end, and both ends of the handle (5) can be attached to the cup. The length of the handle (5) should be sufficient to accommodate and approximate the width of a user's hand, such as a toddler's hand, an adult woman's hand, or an adult man's hand. By "width" of a user's hand is meant the width of the user's hand at the widest point in the region of the palm at or near the knuckles. In this regard, the drinking containers (1) can have handles (5) that differ in length according to an age range of children (e.g., under 6 months of age, 6-12 months of age, and over 12 months of age, and the like) or gender of an adult (i.e., woman or man) so that the length of the handle closely approximates the width of a child's hand at a given age range or an adult's hand, depending on the gender of the user. A handle length that approximates the width of a user's hand allows advantage to be taken of the top of the handle (5), such as by way of the thumb rest (1) and the pointer finger rest (11) described below, and the bottom of the handle (5), such as by way of the little finger rest (12) described below, during raising of the drinking container and sipping from the opening (4).

There can be one or more modifications at the top of the handle (5). For example, there can be a thumb rest (10) on the upper surface of the top of the handle (5). The thumb rest (10) can be used by a left thumb or a right thumb. In this regard, the thumb rest (10) can be contoured, such as with a slight concavity, and offset and slightly angled from the midline of the handle (5) for receiving the fleshy part of the thumb. Also, in this regard, the thumb rest (10) can be bifurcated (i.e., having a left thumb rest and a right thumb rest, even while unitary), such that there is a rest on the right side of the upper surface of the top of the handle for a left thumb and a rest on the left side of the upper surface of the top of the handle for a right thumb. In such an embodiment, the thumb rest can be generally described as heart-shaped.

There can be a pointer finger (i.e., the first finger adjacent to the thumb) rest (11) on the lower surface of the top of the handle (5). The pointer finger rest (11) can be used by a left pointer finger or a right pointer finger. In this regard, the pointer finger rest (11) can be contoured, such as with a slight concavity (see, e.g., FIGS. 1 and 2).

Additionally or alternatively to one or more modifications at the top of the handle (5), there can be one or more modifications at the bottom of the handle (5). For example, the bottom of the handle (5) can be flared. By "flared" is meant that the sideways width of the handle is increased, such that the sideways width of the bottom of the handle is greater than the sideways width of the top of the handle (see, e.g., FIG. 3 for one embodiment). In this regard, the upper surface of the flared bottom of the handle, i.e., the side of the handle that comes in contact with a little finger of a hand, can have a little finger rest (12). The little finger rest can be used by a left little finger or a right little finger. In this regard, the little finger rest (12) can be contoured, such as with a slight concavity. As such, the flared bottom of the handle (5) can rest on the side of a little finger when a hand is holding the handle and the drinking container is being raised and inverted, such as during sipping. The little finger rest (12) can be bifurcated (i.e., having a left little finger rest and a right little finger rest, even while unitary), such that there is a rest on the right side of the upper surface of the bottom of the handle for the side of a right little finger and a rest on the left side of the upper surface of the bottom of the handle for the side of a left little finger.

The handle (5) should be of sufficient thickness to be comfortably gripped by a user's hand. In this regard, the cross-section of the handle, such as in the middle region of the handle (e.g., from the base of any modifications at the top of the handle to the top of any modifications at the bottom of the handle), can be circular, elliptical, and the like, and can include finger grips, such as those shown in FIGS. 1 and 2. The thickness of the handle (5) can vary with the age of a child or the gender of an adult. The thickness of the handle (5) also can take into account other factors, such as whether or not the user has difficulty or pain grasping a thinner handle.

Figure 8A:
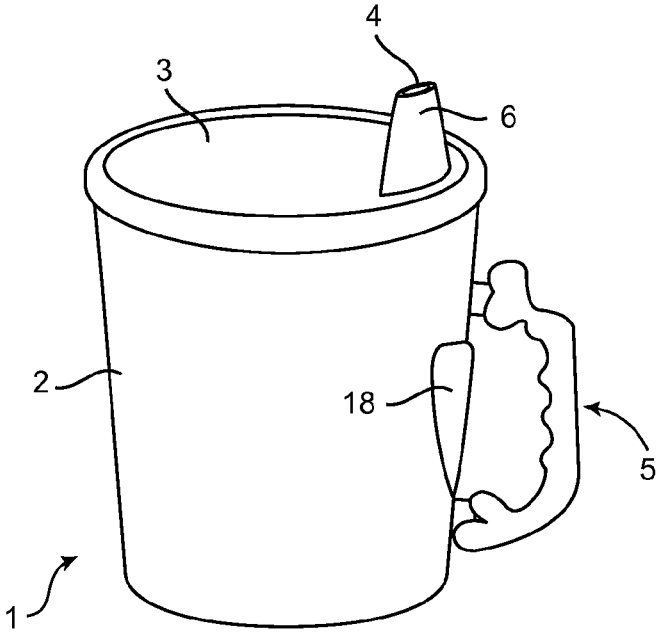
FIG. 8(*a*) is a side view of a drinking container (1) showing a cup (2), a lid (3), an example of a drinking spout (6) with an opening (4), a handle (5), and padding (18), which can help to increase the area of contact between the side of the cup and the dorsal surfaces of the proximal phalanxes.
Figure 8B:
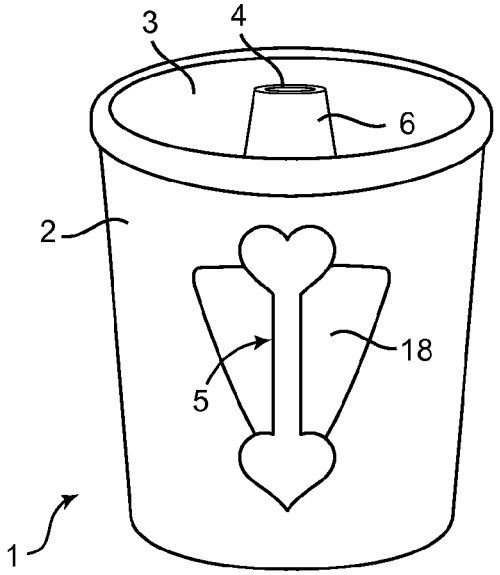

The handle (5) can comprise one or more soft-grip regions. In this regard, the entire inner surface (i.e., the surface of the handle facing the side of the cup), the entire outer surface (i.e., the surface of the handle facing away from the side of the cup), either/both edges, or all surfaces of the handle (5) can be soft for gripping. Indeed, a deformable surface can provide added comfort. In this regard, padding (18), such as deformable padding, can be added to the exterior surface of the cup (2) facing the interior surface of the handle (5), such as shown in FIGS. 8(*a*) and 8(*b*). Such padding can increase the area of contact between the exterior surface of the cup and the dorsal surfaces of the proximal phalanxes, for example, and can distribute the weight of the drinking container across the dorsal side of the hand and can stabilize the drinking container during raising and lowering of the cup while drinking.

The opening (4) in the lid (3) can be in a drinking spout (6). Typically, a drinking spout (6) extends from the upper surface of the lid (3) adjacent to the edge/rim of the lid. A user places the drinking spout (3) into his mouth to sip from the drinking container. See, e.g., the drinking spout (6) shown in FIGS. 1, 2, and 3. The height of the drinking spout (6) can be increased to accommodate the user's chin as necessary, given that the handle (5) is maintained below the opening (4), and to accommodate the vertical positioning of the handle on the side of the cup (2). In this regard, a chin rest can be incorporated into the drinking container (1). For example, a chin rest can be incorporated into the lid (3), such as on the edge of the lid between the opening (4) and the handle (5) (see, e.g., FIGS. 4 and 5).

Alternatively to a drinking spout (6) or other such structure containing the opening (4), the lid (3) can comprise a ridge (7), in which case the opening (4) is adjacent to the inner side (8) (i.e., the side facing the central region of the lid (3)) of the ridge (7), as opposed to the outer side (9) (i.e., the side facing the edge/rim of the lid (3)) of the ridge (7) (see, for example, the rim on the Advance Developmental Cups Insulated Cup-Like Rim product, which is available from Gerber). The ridge (7) can be shallow. The ridge (7) can be curved. The curve can approximate the curve of the edge of the lid or be more pronounced, such as more concave, even U-shaped.

The opening (4) can comprise a slot. Alternatively or additionally, the opening (4) can comprise one or more round or substantially round holes. The slots or holes can be sized to allow for an acceptable flow rate for a liquid, including liquid containing particles, such as pulp, and for ease of cleaning A valve, which closes the opening (4) in a drinking spout (6), for example, or other such structure, until suction is supplied by a user sipping from the drinking container (1), can be preferred over holes or slots that remain permanently open. A valve helps to minimize or prevent liquid leaking from the opening (4) when the drinking container (1) is not in use. A valve, however, can reduce the flow rate and can be difficult to clean. A removable valve can be easier to clean and enables periodic replacement of the valve. Removability, however, can lead to a valve being misplaced. Instead of employing a valve, multiple drinking holes, which are of sufficient size and number to avoid leakage under normal non-suction conditions yet provide an acceptable flow rate under drinking conditions, can be employed as disclosed in U.S. Pat. No. 7,185,784, which is specifically incorporated by reference for its teachings regarding same. Depending on the configuration of the lid (3) and the thickness of the wall of the cup (2), an air vent hole, which is typically a small (e.g., pin-sized) hole on the opposite side of the lid (3) from the opening (4) for egress of liquid, can be employed. An air vent hole can be covered, such as with a finger, to control manually the flow rate of a liquid placed in the drinking container (1), such as when the drinking container (1) is being utilized by a caregiver to provide fluid to a person with dysphagia. Other features can be incorporated into the lid (3) and/or drinking spout (6), or other such structure, to reduce the impact pressure of fluid at the opening when the cup is rapidly inverted. Such features include hole shape (e.g., holes having a curved inner hole edge, holes having a sharp inner hole edge, frustoconical holes, and the like), a shallow dam wall, a baffle, and resilient, outward deformability of the lid (i.e., to create a slight vacuum above the liquid) (see, e.g., U.S. Pat. No. 7,185,784, which is specifically incorporated by reference for its teachings regarding same). The drinking spout (6) can be hinged, in which case it can be folded down, such as in or on the lid, when not in use. When the drinking spout (6) is folded down, liquid does not leak out from the drinking container (1) through the drinking spout (6). When the drinking spout (6) can fold down, the lid (3) can further comprise a cover, such as a sliding lid/cap, for the drinking spout (3). The cover, such as a sliding lid/cap, can help to maintain the drinking spout (6) in the folded down position and shield the drinking spout (6) from the environment. The drinking spout (6) can be removable and replaceable.

Figure 2:
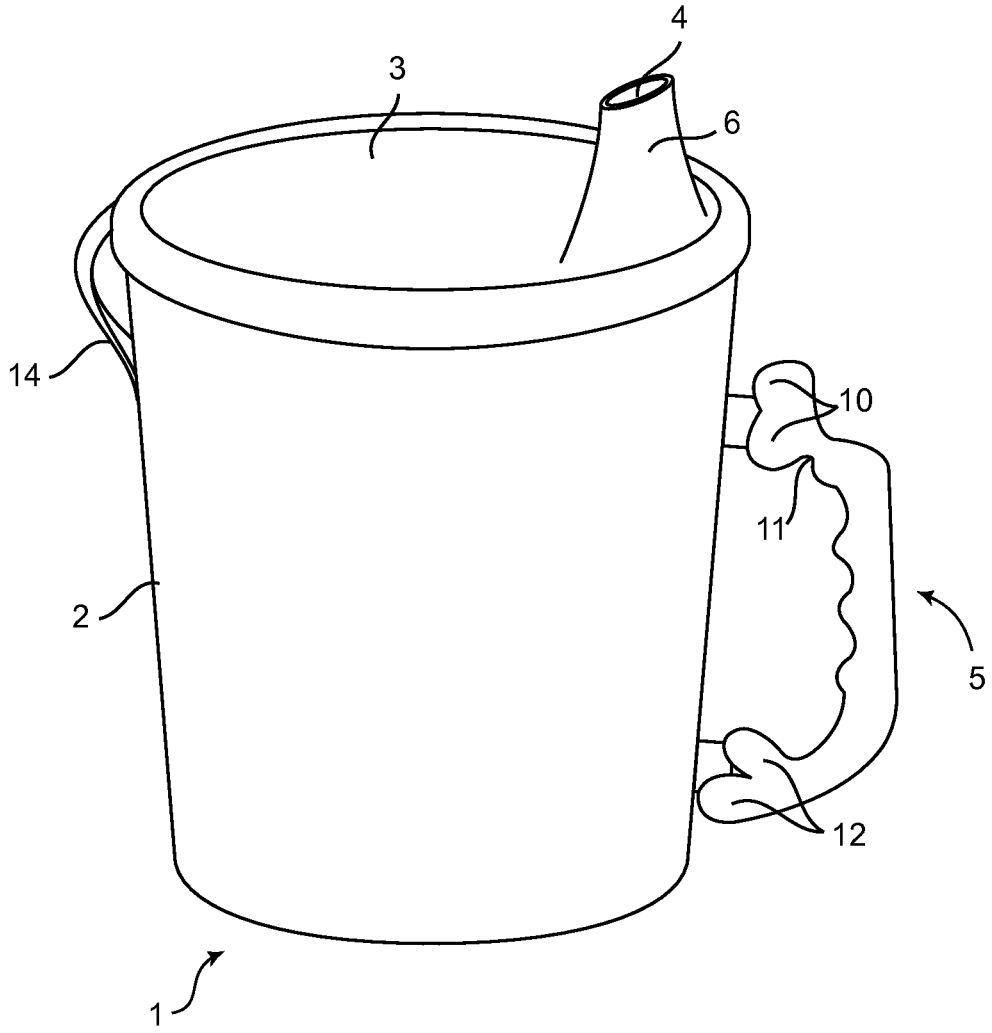
FIG. 2 is a side view of a drinking container (1). Shown are a cup (2), a lid (3), which snaps on, an opening (4), a handle (5), an example of a drinking spout (6), an example of a thumb rest (10), which is shown bifurcated and generally heart-shaped when viewed from its top side, a pointer finger rest (11), and an example of a little finger rest (12), which is shown bifurcated. Also shown is a hinge (14) as an example of a means of attaching the lid to the cup and maintaining the opening (4) in the lid (3) above and aligned with the handle (5).
Figure 3:
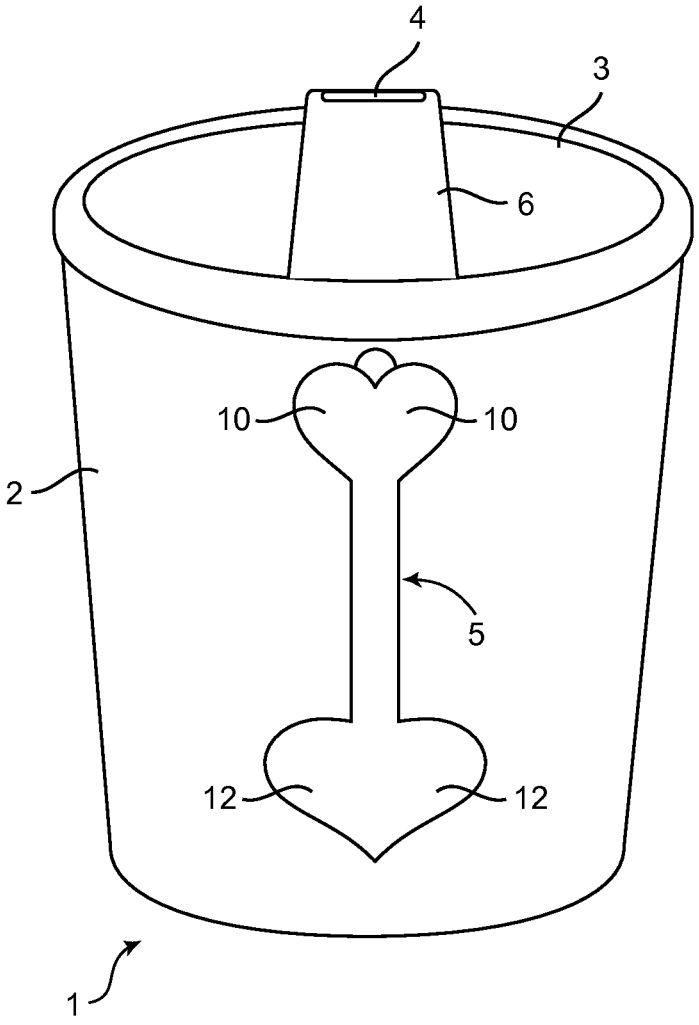
FIG. 3 is another side view of a drinking container (1). Shown are a cup (2), a lid (3), an opening (4), a handle (5), an example of a drinking spout (6), an example of a thumb rest (10), which is shown bifurcated and generally heart-shaped when viewed from its top side, and an example of a little finger rest (12), which is shown bifurcated.
Figure 6A:
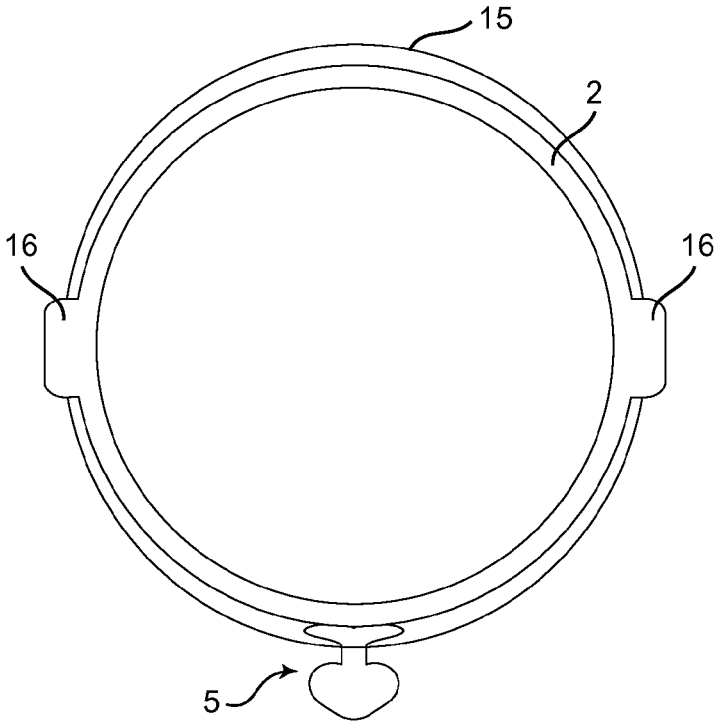
FIG. 6(*a*) is a top view of a cup (2). Shown are two tabs (16), a handle (5), and a tether (15), which keeps the lid attached to the cup when the lid is untwisted from the cup.
Figure 6B:
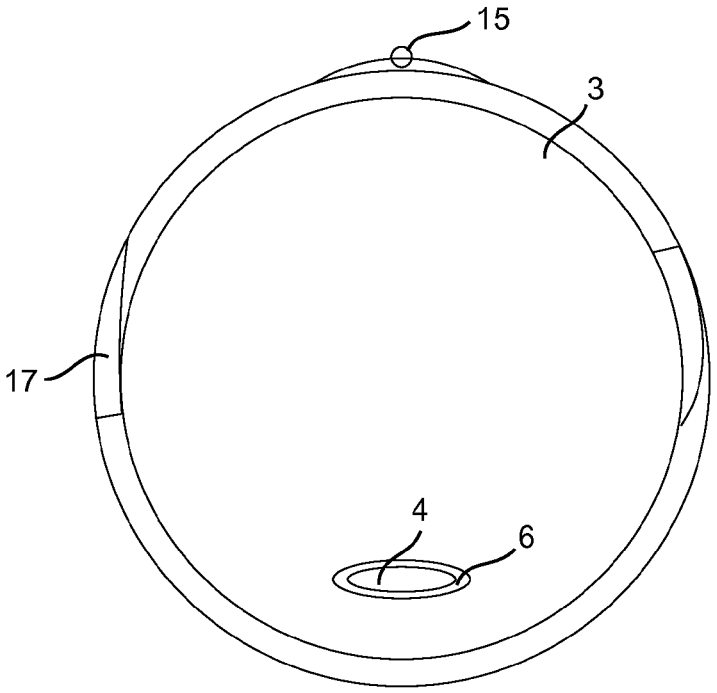

When the lid (3) is on the cup (2), a leak-proof (i.e., an air-tight) seal is formed between the lid (3) and the cup (2). The lid (3) can be placed on the cup (2) in any suitable manner. For example, the lid (3) can snap on the cup (e.g., friction fit), such as shown in FIGS. 2 and 3, or twist on the cup (e.g., tabs in slots), such as shown in FIGS. 6(*a*) and 6(*b*) (see, e.g., U.S. Pat. No. 8,286,826, which is specifically incorporated by reference for its teachings regarding same).

If the lid (3) snaps or twists on the cup (2), the lid (3) snaps or twists on the cup (2) in a single orientation, i.e., with the opening (4) above the handle (5), thereby maintaining the position of the handle (5) below the opening (4) in the lid (3). A single orientation can be realized by any suitable means known in the art. For example, when the lid (3) snaps on the cup (2), a hinge (14), such as a flexible, stationary hinge, can maintain the opening (4) above the handle (5) (see, e.g., U.S. Pat. App. Pub. No. 2006/006184, which is specifically incorporated by reference for its teaching regarding a hinge). The hinge can be placed at any suitable position; however, the placement of the hinge should not interfere with drinking from the drinking spout or placing the hand on the handle. In this regard, assuming the handle is at 1°, the hinge can be placed, for example, from about 45° to about 315°, in particular at about 180°, i.e., about directly opposite the handle and the drinking spout. Alternatively, a lid and a cup with mating features, for example, as known in the art, can be used to control the orientation of the opening (4) in the lid (3) with the handle (5) of the cup (2). For example, when the lid (3) twists on the cup (2), tabs (16) on the cup, such as one tab on each side of the cup, can engage with slots (17) on the lid, such as one slot on each side of the lid with the drinking spout (6) disposed midway there between (the reverse is also possible, with tabs on the lid and slots on the cup). When the lid (3) twists on the cup (2), a tether (15) can keep the lid (3) attached to the cup (2) when the lid (3) is untwisted from the cup (2).

Figure 1:
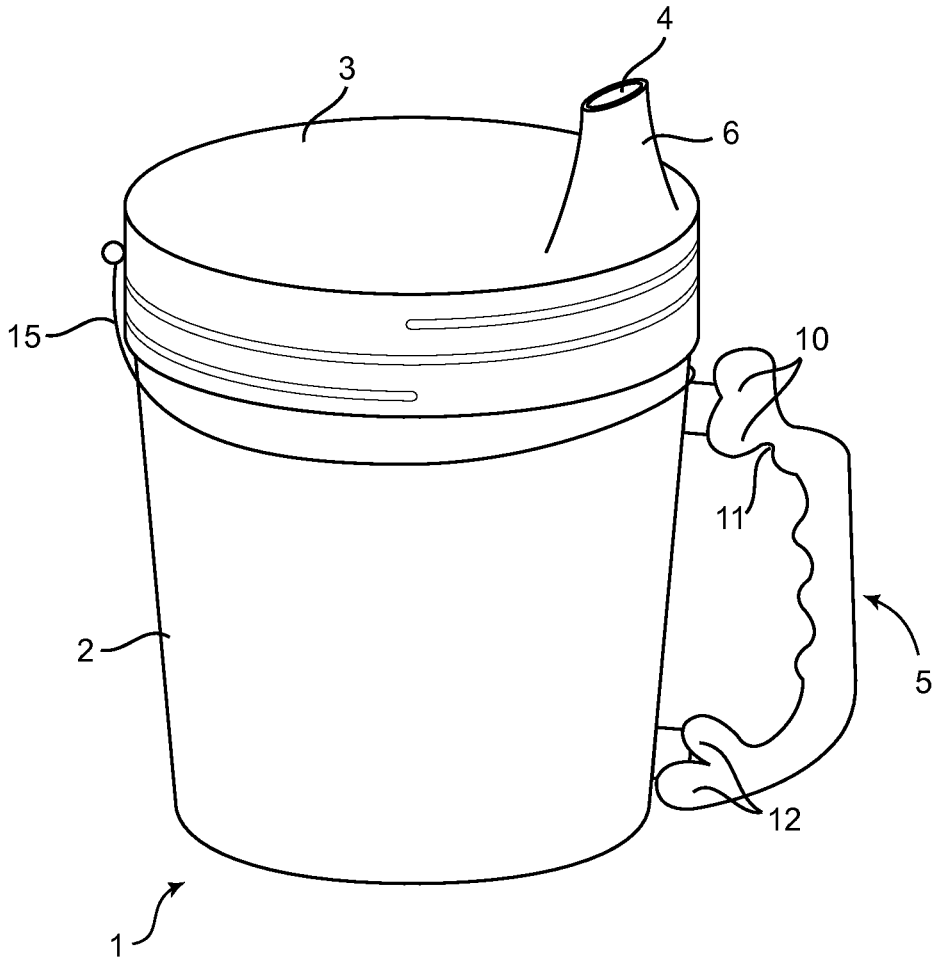
FIG. 1 is a side view of a drinking container (1). Shown are a cup (2), a lid (3), which screws on, an opening (4), a handle (5), an example of a drinking spout (6), an example of a thumb rest (10), which is shown bifurcated and generally heart-shaped when viewed from its top side, a pointer finger rest (11), and an example of a little finger rest (12), which is shown bifurcated. Also shown is a tether (15), which keeps the lid (3) attached to the cup (2) when the lid (3) is unscrewed from the cup (2).

Alternatively, the lid (3) can screw on the cup (2), such as shown in FIG. 1. If the lid (3) screws on the cup (2), the lid (3) screws on the cup (2) in such a manner that the position of the opening (4) is maintained above and aligned with the handle (5) when the lid (3) is fully screwed on; in other words, the position of the handle (5) is maintained below and aligned with the opening (4) in the lid (3).

Irrespective of the manner in which the lid (3) is placed on the cup (2), either (i) an annular ring on the lid and an annular grove on the cup or (ii) an annular grove on the lid and an annular ring on the cup can be used to form an air-tight seal. When the lid (3) screws or twists on the cup (2), the drinking container (1) can further comprise a tether (15) to keep the lid (3) attached to the cup (2).

The drinking container (1) can further comprise a tab for prying off the lid (3), such as a lid (3) that snaps on. The tab can extend laterally from an edge of the lid (3), such as on the opposite side from the opening (4) for egress of a liquid. In this regard, the drinking container (1) can further comprise another tab, which can extend laterally from an edge of the cup (2) immediately adjacent the tab that extends laterally from an edge of the lid (3). Such a configuration allows one tab to be pushed in one direction (e.g., the tab on the lid can be pushed up) and the other tab to be pushed in the opposite direction (e.g., the tab on the cup can be pushed down) to aid in prying off the lid (3) from the cup (2). If desired, the drinking container (1) can comprise two tabs (i.e., two squeeze tabs), one on each side of the lid, which must be squeezed simultaneously in order to remove the lid from the cup (see, e.g., U.S. Pat. No. 8,118,182, which is specifically incorporated by reference for its teaching regarding same).

The cup (2) can be weighted adjacent to the handle (5). The cup can be weighted adjacent to the top of the handle, the bottom of the handle, or both. Weighting of the cup adjacent to the top of the handle can place more weight on the thumb of the user, whereas weighting of the cup adjacent to the bottom of the handle can place more weight on the user's little finger. Weighting of the cup can help the user balance the cup on the hand when sipping from the cup. When both the top of the handle and the bottom of the handle are weighted, the weighting is equal and the combined weighting is equal to or less than the weighting at the top of the handle or the bottom of the handle when only one or the other is weighted. The weighting should be no greater than that which helps to balance the cup on the hand. The weighting should not be so substantial as to cause unnecessary stress on the user's hand or pressure on the user's mouth region when sipping from the cup. In this regard, it should be noted that weighting of the cup can be achieved through the use of an internal partition as described herein below.

The bottom of the cup (2) can flare outwardly. The bottom of the cup can flare outwardly along some, most, substantially all, or all the perimeter. Flaring of the bottom of the cup outwardly along most, substantially all, or all of the perimeter can help to stabilize the cup when it is placed on a surface, such as a flat surface. Flaring of the bottom of the cup outwardly along the perimeter in the region of the handle (5), such as below the handle, can help to weight the cup adjacent to the bottom of the handle. As noted above, weighting of the cup adjacent to the bottom of the handle can place more weight on the user's little finger. Weighting of the cup can help the user balance the cup on the hand when sipping from the cup. As noted above, the weighting should be no greater than that which helps to balance the cup on the hand. The weighting of the cup should not be so substantial as to cause unnecessary stress on the user's hand or pressure on the user's mouth region when sipping from the cup. Flaring of the bottom of the cup can extend upward along some or all of the height of the cup and/or along some or all the circumference of the cup. In this regard, flaring of the bottom of the cup can extend upward along at least some of the side wall in the region of the handle. The flaring can be accomplished by an increase in thickness of the wall of the cup. Alternatively or additionally, the bottom of the handle can flare outwardly.

The bottom of the cup (2) can be skid-resistant. Skid-resistance can be achieved by texturing the bottom of the cup or by the use of a material that, by its nature, resists skidding. For example, the bottom of the cup can be coated with a layer of silicone or another material (e.g., thermoplastic elastomer) that resists skidding.

The drinking container (2) can further comprise a cap for the drinking spout (6). The cap can remain attached to the lid, such as by a flexible hinge or a tether, when not in use. Alternatively, the tether can be snapped on and off the lid, in particular a lid that snaps on the cup (see, e.g., The First Years Take & Toss Spill Proof Cups with Bonus Drip-Free Cap). The cap can be flexible.

The cup (2) can comprise an internal wall, which is angled towards the opening (4) in the lid (3) and divides the cup (2) into a front reservoir and a rear reservoir. In one embodiment, a front reservoir, which is opposite the side with the handle and in fluid communication with the opening (4) in the lid (3), is filled with liquid (see, e.g., U.S. Pat. No. 8,418,877, which is specifically incorporated by reference for its teachings regarding an internal partition that is angled toward the mouth of the Sippy cup and reportedly decreases the amount of tilt required to dispense the liquid from the cup). In another embodiment, the rear reservoir, which is adjacent to the side with the handle (5) and in fluid communication with the opening (4) in the lid (3), is filled with liquid.

If desired, the drinking container (1) can be self-righting. U.S. Pat. App. Pub. No. 2008/0257845 is specifically incorporated by reference for its teachings regarding self-righting of a container. Typically, the bottom of a self-righting drinking container is convex.

The drinking container (1) can be made of any suitable material. The drinking container is made from plastic, in particular plastic that does not contain bisphenol A (BPA), polyvinyl chloride (PVC), and phthalates (i.e., a plastic that is CPSIA compliant). The material can be impact-resistant or shatter-resistant, light-weight, and thin. The material should meet FDA and other governmental standards for use in contact with food. An impact strength-enhancing modifier can be added. A microwaveable and dishwasher-safe material can be preferred. Examples of suitable materials include, but are not limited to, plastic, high density polyethylene, low density polyethylene, polycarbonate, polypropylene, and polypropylene random copolymer resin, such as high clarity, polypropylene random copolymer resin (e.g., PRO-FAX SW-555M or MOPLEN RP348N, both of which are available from Basell, Wilmington, Del.). The cup (2) and the lid (3) can be made from the same material so that the cup and the lid expand and contract in the same manner under given conditions. The lid (3) and cup (2) should have a shape and thickness that impart sufficient rigidity to the drinking container (1). In this regard, the selection of material and manufacturing conditions, such as cure time and cure rate, also can impact rigidity. If the cup (2) and the lid (3) are made from different materials, it can be preferred to use an annular flange and an annular ring as described above to prevent leaks. When the lid (3) comprises a drinking spout (6), alone or in further combination with a valve, it can be preferable and even desirable for the drinking spout (6) and, when present, the valve, to be made from a different material than the lid, such as a flexible material, e.g., silicone. The valve can further comprise a stabilizing core (see, e.g., U.S.

Pat. No. 8,256,642, which is specifically incorporated by reference for its teachings regarding same).

While the drinking container (1) can have any suitable shape, the lid (3) and the cup (2) must be able to mate and form a leak-proof (i.e., airtight) seal when the lid (3) is on the cup (2). When the lid (3) screws or twists on the cup (2), the circumference of the lid (3) and the cup (2) are round. A generally cylindrical, such as a tapered cylindrical, shape can be preferred for the cup (2). The cup (2) can hold at least about 4 ounces up to about 8 ounces for younger children, for example, and as much as about 10 ounces to about 12 ounces for older children and adults, for example. The weight of the drinking container (1) and either the age of the child or the gender of the adult using the drinking container (1) should be taken into consideration when determining the maximum volume of the drinking container (1).

If desired, such as for an adult with limited neck extension, the top of the drinking container (1) can be angled downwardly from the edge adjacent the opening in the lid to the opposite edge (see, e.g., "nosey cups," which have a lower edge on one side). The angle can be any suitable angle, such as around 30-45°, for example. Alternatively, if desired, such as for an adult with dysphagia, a drinking spout (6) in the lid (3) can be positioned at or near the plane of the lid, or even somewhat below, such as between the lower surface of the lid (3) and the upper surface of the top of the handle (5).

The drinking container (1) can be dishwasher safe. The drinking container (1) can be microwaveable. The drinking container (1) can be recyclable. The drinking container (1) can be disposable, if desired.

In view of the above, also provided is a method of making the drinking container (1). The drinking container (1) can be made using materials, such as those describe above and others known in the art, in accordance with methods known in the art. For example, (i) the drinking spout (6), ridge (7) or other such structure, (ii) the lid (3), or both (i) and (ii), such as when the drinking spout (6), ridge (7) or other such structure is an integral part of the lid, can be molded. Slots and holes in the lid (3), drinking spout (6), or other such structure can be formed during molding (e.g., fixed pin rigidly pressed into one of two opposing mold halves and extending either into a corresponding hole in the opposite mold half or of sufficient length to butt up against the opposing mold surface, such as described in U.S. Pat. No. 7,185,784, which is specifically incorporated by reference for its teaching regarding same) or after molding. In this regard, slots and holes can be formed by piercing or laser-cutting. Common manufacturing processes for plastics include injection molding, compression molding, and the like.

It will be understood by one of ordinary skill in the art that the features of the drinking container described herein have application to a wide range of drinking containers, including, but not limited to, Sippy cups, sports drinking containers, travel drinking containers, and the like.

All patents, patent application publications, journal articles, textbooks, and other publications mentioned in the specification are indicative of the level of skill of those in the art to which the disclosure pertains. All such publications are incorporated herein by reference to the same extent as if each individual publication were specifically and individually indicated to be incorporated by reference.

The invention illustratively described herein may be suitably practiced in the absence of any element(s) or limitation(s), which is/are not specifically disclosed herein. Thus, for example, each instance herein of any of the terms "comprising," "consisting essentially of," and "consisting of" may be replaced with either of the other two terms. Likewise, the singular forms "a," "an," and "the" include plural references unless the context clearly dictates otherwise. Thus, for example, references to "the method" includes one or more methods and/or steps of the type, which are described herein and/or which will become apparent to those ordinarily skilled in the art upon reading the disclosure.

The terms and expressions, which have been employed, are used as terms of description and not of limitation. There also is no intention in the use of such terms and expressions of excluding any equivalents of the features shown and described or portions thereof.

It is recognized that various modifications are possible within the scope of the claimed invention. Thus, it should be understood that, although the present invention has been specifically disclosed in the context of preferred embodiments and optional features, those skilled in the art may resort to modifications and variations of the concepts disclosed herein. Such modifications and variations are considered to be within the scope of the invention as defined by the appended claims.

What is claimed is:

1. A drinking container (1) comprising a cup (2) and a lid (3), wherein:

the lid (3) comprises an opening (4) for egress of a liquid placed inside the cup (2), the cup (2) comprises only one handle (5), which is directly connected to the cup only and the length of which can be encircled by the fingers of a hand and thereby gripped for raising and lowering the drinking container, and, when the lid (3) is fully engaged with the cup (2), the opening (4) in the lid (3) can only be maintained on the same side of the cup as the handle (5), wherein the opening (4) is above and aligned with the handle (5).

2. The drinking container of claim 1, wherein the lid (3) screws on the cup (2).

3. The drinking container of claim 2, which further comprises a tether (15), which keeps the lid (3) attached to the cup (2) when the lid (3) is not screwed on the cup (2).

4. The drinking container of claim 1, which further comprises a hinge (14), which attaches the lid (3) to the cup (2) and the lid (3) snaps on the cup (2).

5. The drinking container of claim 1, wherein the lid (3) further comprises at least two slots (17) and the cup further comprises at least two tabs (16) and the lid (3) twists on the cup (2).

6. The drinking container of claim 5, which further comprises a tether (15), which keeps the lid (3) attached to the cup (2) when the lid (3) is not twisted on the cup (2).

7. The drinking container of claim 1, wherein the lid (3) further comprises a drinking spout (6) and the opening (4) is in the drinking spout (6).

8. The drinking container of claim 1, wherein the lid (3) comprises a ridge (7), which has an inner side (8) and an outer side (9), and the opening (4) is adjacent to the inner side (8) of the ridge.

9. The drinking container of claim 1, wherein the handle (5) has a thumb rest (10) on the upper surface of the top of the handle (5).

10. The drinking container of claim 9, wherein the thumb rest (10) is bifurcated, having a left thumb rest and a right thumb rest.

11. The drinking container of claim 1, wherein the handle (5) has a pointer finger (11) rest on the lower surface of the top of the handle (5).

12. The drinking container of claim 1, wherein the bottom of the handle (5) is flared.

13. The drinking container of claim 1, wherein the handle (5) has a little finger rest (12) on the upper surface of the bottom of the handle (5).

14. The drinking container of claim 13, wherein the little finger rest (12) is bifurcated, having a left little finger rest and a right little finger rest.

15. The drinking container of claim 1, which further comprises a chin rest (13).

16. The drinking container of claim 15, wherein the chin rest (13) is on the lid.

17. The drinking container of claim 1, which further comprises padding (18) on the side of the cup (2) facing the inside of the handle (5).

* * * * *